US010508397B2

(12) United States Patent
Rôla et al.

(10) Patent No.: US 10,508,397 B2
(45) Date of Patent: Dec. 17, 2019

(54) ANTI-EROSION SYSTEM MADE OF GEOSYNTHETIC MATERIAL

(71) Applicant: SICORNETE-FIOS E REDES, LDA., Ovar (PT)

(72) Inventors: Filipe Rôla, Ovar (PT); José Carlos Oliveira, Ovar (PT)

(73) Assignee: SICORNETE-FIOS E REDES, LDA., Ovar (PT)

( * ) Notice: Subject to any disclaimer, the term of this patent is extended or adjusted under 35 U.S.C. 154(b) by 0 days.

(21) Appl. No.: 16/081,907

(22) PCT Filed: Feb. 27, 2017

(86) PCT No.: PCT/IB2017/051127
§ 371 (c)(1),
(2) Date: Sep. 2, 2018

(87) PCT Pub. No.: WO2017/149431
PCT Pub. Date: Sep. 8, 2017

(65) Prior Publication Data

US 2019/0093297 A1 Mar. 28, 2019

(30) Foreign Application Priority Data

Mar. 1, 2016 (PT) ..... 109199

(51) Int. Cl.

| | |
|---|---|
| ***E02B 3/04*** | (2006.01) |
| ***E02B 3/12*** | (2006.01) |
| ***E02B 3/10*** | (2006.01) |
| ***E02D 17/20*** | (2006.01) |

(52) U.S. Cl.
CPC ..... *E02B 3/122* (2013.01); *E02B 3/04* (2013.01); *E02B 3/046* (2013.01); *E02B 3/108* (2013.01); *E02D 17/202* (2013.01); *E02D 2200/1685* (2013.01); *E02D 2220/00* (2013.01); *E02D 2300/001* (2013.01); *E02D 2300/0009* (2013.01); *E02D 2300/0087* (2013.01)

(58) Field of Classification Search
CPC ..... E02D 17/202; E02D 2300/0087; D03D 15/0027; E02B 3/122; E02B 3/108; E02B 3/046; Y10T 442/3065
See application file for complete search history.

(56) References Cited

U.S. PATENT DOCUMENTS

| | | | | |
|---|---|---|---|---|
| 5,965,467 | A * | 10/1999 | Stevenson | D03D 9/00 405/129.75 |
| 10,094,085 | B2 * | 10/2018 | Walmsley | E02B 3/123 |
| 2011/0206458 | A1 * | 8/2011 | Jones | D03D 1/0041 405/19 |
| 2015/0159305 | A1 * | 6/2015 | Booth | D03D 15/0088 442/189 |
| 2017/0354907 | A1 * | 12/2017 | Ray | D02G 3/36 |
| 2018/0320332 | A1 * | 11/2018 | Booth | E01C 7/325 |

OTHER PUBLICATIONS

European Standard "Geotextiles and geotextile-related products—Determination of the resistance to weathering" EN 12224:2000, ICS 59.080.70, Sep. 2000.
European Standard "Geosynthetics—General tests for evaluation following durability testing" EN12226, ICS 59.080.70, Jan. 2012.
European Standard "Geotextiles and geotextile-related products—Characteristics required for use in erosion control works (coastal protection, blank revetments)" EN13253, ICS 59.080.70, Oct. 2016.
European Standard "Geosynthetics—Wide-width tensile test (ISO 10319:2015)" EN ISO 10319, ICS 59.080.70, May 2015.
European Standard "Geosynthetics—Static puncture test (CBR test) (ISO 12236:2006)" EN ISO 12236, ICS 59.080.70, Sep. 2006.
European Standard "Geosynthetics—Dynamic perforation test (cone drop test) (ISO 13433:2006)" EN ISO 13433, ICS 59..080.70, Aug. 2006.
International Standard "Geosynthetics—Tensile test for joints/seams by wide-width strip method" ISO 10321, second edition Apr. 15, 2008.
International Standard "Geosynthetics—Index test procedure for the evaluation of mechanical damage under repeated loading—Damage caused by granular material" ISO 10722, First edition May 15, 2007.
Norma Portuguesa "Geotextiles and geotextile-related products Determination of the resistance to weathering" NP EN 12224, 2007.
L. Das Neves et al. "Experimental Study on the Effect of Geotextile Encapsulated-Sand Systems on a Frontal Beach" Journal of Coastal Research SI 64, 2027-2031, ICS2011, Poland, ISSN 0749-0208, 2011.

* cited by examiner

*Primary Examiner* — Carib A Oquendo
(74) *Attorney, Agent, or Firm* — Mark M. Friedman

(57) ABSTRACT

The present invention relates to an anti-erosion system made of geo-synthetic material, preferably of polysteel raw material (polypropylene (PP) and polyethylene (PE) mixture) instead of only polypropylene or polyester or nylon, resulting in a compromise between the mechanical properties of polypropylene, the chemical properties of polyethylene, and the good resistance to the environmental agents achieved through the incorporation of molecular chain stabilizers. The fraction of PP should range from 50% to 90% and the fraction of PE from 10% to 50%.

6 Claims, No Drawings

ANTI-EROSION SYSTEM MADE OF GEOSYNTHETIC MATERIAL

TECHNICAL FIELD AND FRAMEWORK OF THE INVENTION

The present invention is an anti-erosion system made of geo-synthetic material, the purpose of which is to provide a smooth and sustainable anti-erosion protection process adapted to severe hydrodynamic conditions.

STATE-OF-THE ART OF THE INVENTION

Erosion phenomena, especially in coastal zones as well as in river basins, have significant economic, social and environmental impacts. Nowadays, this issue is of major concern, which is augmented by climate changes and by the occurrence of extreme hydrological phenomena. Solutions based on geo-synthetic materials have good potential in this field.

According to das Neves (2011), there are several concerns related to the materials and due to the use of geo-synthetics in coastal protection works, such as in the design and implementation of these technologies (for example, seam resistance, displacement of individual elements, subsidence, etc.). He also states that, in addition to the requirements related with the durability, for example the resistance to the UV radiation, it seems that a composite material combining permeability and drainage properties (hydraulics) with strength properties is most suitable for this type of application. The permeability allows water flowing freely through the sand grains, which means that during wave attack the forces can be absorbed by the sand grains and not by the geotextile. Good drainage properties ensure that water is released quickly without any increase in pressure. Good mechanical properties guarantee survival during filling/settlement as well as a better response during the construction lifespan, particularly in situations of differential displacements inducing additional stresses, and also in cases of vandalism.

Sand confinement geosystems, namely with cylindrical configurations, may respond positively to a growing demand for new flexible, reversible and less impacting techniques, from the landscape point of view, of coastal defense. However, its widespread use as a permanent structure presents some significant challenges, especially in coastal zones exposed to sea rippling with high-energy characteristics.

The main advantage of sand confinement systems incorporating geotextile material, compared to conventional systems made of rock blocks or concrete blocks, is related with its ability to reduce erosion, with a limited and non-permanent impact on natural coastal processes, since they can be easily removed if necessary. Other advantages generally include the cost and ease of construction. They can also be reinforced with other elements if it is advised from its performance monitoring.

It should also be mentioned, in the context of the present invention and state-of-the-art knowledge, that erosion cliffs on sandy beaches or dunes may be protected with a resistant front core made of cylinders in geo-synthetic material capable of retaining the sedimentary material (sand) with which they will be filled. Also, in order to provide better landscape integration and beach use, the cylinders filled with sand may be covered with sand after they have been filled in case they are emerged and, if necessary, later at the end of the winter periods and beginning of the bathing season. It should be noted that the material seams should receive special attention. The characteristics of the geotextile material should be compatible with NP EN 13253: 2006—"Geotêxteis e produtos relacionados—Características requeridas para a utilização em obras para controle da erosão (proteção costeira, revestimento das margens)" "Geotextiles and related products—Required characteristics for use in erosion control works (Coastal protection, margins covering)". The main functions of the geotextile are filtration and reinforcement by confinement, and it must have adequate resistance to ultraviolet radiation and tested to the: "Resistência à tração de costuras/juntas" "Tensile strength of seams/joints" (EN ISO 10321: 2008); "Resistência a danos causados durante a instalação" "Resistance to damage caused during installation" (EN ISO 10722: 2007); "Resistência ao punçoamento estático" "Static puncture resistance" (ISO 12236: 2006).

The present invention allows direct contact with natural or artificial rigid elements (vulnerability to puncture and acts of vandalism) and, in addition to the confinement capacity of sedimentary products, namely sand, it constitutes a tubular structure of coastal defense with hydraulic filling (water and sediments)—and, compared to prior-art inventions, this invention is structurally prepared to be subjected to the dynamic actions of the sea rippling and in direct contact with rock elements (natural rocks or rockfill blocks) or with concrete elements. These dynamic actions originate movements and oscillations of the cellular structure, and the friction with external solid borders can cause breakage by excessive puncture, abrasion and fatigue.

If located in coastal areas, it is also a more robust solution regarding the acts of vandalism (cuts with razor and knives) or to accidental punctures caused by the shaft of beach umbrellas or by fishing rods.

Other prior-art inventions do not disclose said mechanical resistance capability, in the presence of external solid elements or in connection with acts of vandalism and accidental punctures. In order to achieve adequate resistance capability, it is necessary to consider additional screens or layers surrounding the tubular structure, which requires an increase in the area of the materials and an increase in the required time and difficulties for its placing during works.

DESCRIPTION OF THE INVENTION

The present invention relates to an anti-erosion system made of geo-synthetic material, preferably of polysteel raw material (polypropylene (PP) and polyethylene (PE) mixture) instead of only polypropylene or polyester or nylon, resulting in a compromise between the mechanical properties of polypropylene, the chemical properties of polyethylene, and the good resistance to the environmental agents achieved through the incorporation of molecular chain stabilizers. The fraction of PP should range from 50% to 90% and the fraction of PE from 10% to 50%.

In order to identify the technical effect of the mixture between Polyethylene (PE) and Polypropylene (PP), it should be noted that this mixture provides a high resistance material, with a high capacity to withstand mechanical and chemical stresses such as severe weather, climatic and environmental elements, chemical attack, human action and fatigue.

This raw material is used in the construction of the material of the system object of the present invention, i.e., in the construction of the fabric, which is basically a warp made of braided yarn and a weft of twisted yarn with closed tops and edges, instead of the known gauze or selvedge folded at the edges. The braided yarn is made through filament interleaving. Preferably, this yarn consists in the interleaving of 1680 Denier filaments, individually placed in sixteen spools (sixteen braids) around a core of 5 filaments of 1680 Denier produced with the same combination of above-mentioned raw materials, or another, and in a construction of 3.01 points per centimeter. The outer filament of the yarn becomes a mesh. In this way, the known use of twisted yarn, or yarn tape, or mono multifilament, is substituted.

In order to identify the technical effect, it should be noted that the braided yarn has a larger outer surface than a normal twisted yarn, due to its interleaved construction. This outer surface acts as a shield to the core filaments placed inside. This yarn construction together with the raw materials used allows for:

- Higher stability of properties—since the core has an outer shield against external elements, these properties are maintained for longer periods;
- Higher abrasion resistance—because of the larger outer surface there is more material to "wear out" for the same space, which allows greater resistance against the dynamic action of rocks, gravel, water, etc.;
- Improved resistance to UV radiation—besides the core being protected by an outer shield, the interleaving of outer filaments allows the filaments to cross and creates a multilayer of filaments around the core. This means that, when the filaments cross each other, they are always hidden by other filaments along the yarn, and therefore will be protected from exposure to UV radiation (unlike twisted yarn, in which the filaments are permanently exposed, considering the same type of UV radiation). This means that those filaments will have a less degradation and more resistance;
- Reduced yarn mode and fabric failure due to filament breaking—because of the interleaving and crossing of yarns, when a filament breaks the resistance loss will be limited to the adjacent cross of filaments and will be compensated by the other filaments, which prevents the propagation of a resistance loss (in the case of a twisted yarn, the resistance loss due to a filament breaking would be proportional to the number of filaments in the yarn, i.e., a broken filament in 10 filaments means 10% less of resistance);
- High resistance to static and dynamic puncture—because of the yarn construction, it is possible to install it in rocky terrain without risk of tearing. It also presents high resistance to accidental tearing caused by fishing rods, beach umbrellas, knives, vandalism, etc.

Fabric construction can be achieved either on a circular-multilayer-3D loom or on a flat loom with or without Jacquard, using shuttle, tweezer, projectile or air jet as a means for constructing the weft.

The sewing thread for sew the cylinder tops and edges is polyethylene with ultrahigh molecular weight, and is interleaved in order to increase strength.

All these features provide the following advantages over the prior art:

a) High tensile strength (tested according to NP EN ISO 10319-2005), which is about twice of that of the Tencate, which minimizes the risk of collapse and tearing;

b) High abrasion resistance due to the raw material used and to the braided yarn which, if this characteristic is required, make unnecessary to use an abrasion apron covering the geo-tube as is the case with the Tencate;

c) High resistance to static (EN ISO 12236) and dynamic (EN ISO 13433) puncturing (it is not possible to test this according to available standards because the product exceeds the limits of the standard and of the test equipment), and improved security against acts of vandalism and against the impact of foreign objects in the fabric. This is achieved by using a single-layer tube;

d) High resistance to the UV radiation (tested according to EN 12226 (2012) & EN 12224 (2007)), and the mechanical properties are essentially maintained (over 80% of the initial tensile strength in both the mesh and transversal directions) at the end of the expected life cycle (25 years) and even higher than other competing products, such as Tencate in the initial state;

e) High seam resistance (tested according to EN ISO 10321 (2008)), which is improved by the closed edges and which no competitor has.

The present invention may preferably be embodied as cylinders or tubes, which are located in the water plane with permanently emerged or immersed crest levels, or in the zone between tidal levels in which the structure may be alternately emerged or immersed. In this case, they work as artificial reefs or as detached breakwaters, being able to perform functions or multi-functions of coastal defense, biological colonization, or improved conditions for the practice of surfing.

Depending on the objectives to be achieved and the local environmental conditions (tides, waves, currents, sediments), several alternatives may be considered, namely regarding the foundation levels, crest levels, guideline in plan-view, extension in plan-view, beach profiles, diameters, use of several cylinders (cylinder rows, overlapping or not), landscape integration, costs.

Cylinders partially filled with sand should be positioned along one or more rows, with the underside at predetermined levels and geometric characteristics also predefined based on numerical studies, laboratory tests and acquired experience. It is expected that the "oval" width of the initially cylindrical tubes partially filled with sand is greater than the nominal diameter, in a ratio depending on the manufacturers and the filling technique.

The number of cylindrical units that configure a given extension of intervention should be optimized according to the installation capacity (for example, the periods necessary to its filling). The top will be flat in the contact area between individual tubes. The ends without continuation will be of the conical type. The guideline is polygonal, but "smoothed" in order to better adjust the intervention to the existing configuration on the beach and dune, at the time of the intervention. In the construction phase, the "smoothed" polygonal guideline may be slightly adjusted, depending on the variation of the local topographic conditions and technical adjustments (for example, as a result of the lengths of the cylindrical units which constitute the entire length of the structure).

The foundation bed of the cylinders should be pre-prepared by moving the sand in order to form a configuration similar to that the cylinder acquires after filling.

Since encapsulated sand geotextile systems respond positively to the flexibility requirements, as they are able to decelerate erosion with a limited and non-permanent impact on the natural coast and riparian zones, the present invention may preferably be an encapsulated sand anti-erosion system made of the material defined in the present invention and its preferred forms, which is injected with sand from the zone where it is installed. The set of the various "capsules" packaged with different configurations creates a solid structure which prevents erosion and improves sediment retention.

Geo-synthetic cylinders are prefabricated and filled in situ by hydraulic pumping, and it is possible to predict the use of a given volume of sand per meter of length of the containment structure, which depends on the nominal diameter. Hydraulic filling with sediments (sediments and water in a ratio that may be three or four parts of water to one part of sediment) is carried out by pumping through "openings" located in the cylinder crest and not very spaced apart.

When the cylinders are positioned in submerged zones, they may be filled with sediments at another location, transported by barges and "sunk". For durability reasons regarding mechanical strength, there should be no direct contact between geo-synthetic cylinders and natural rock formations or eventual rockfill blocks, concrete elements, wood stakes, or other rigid elements present at the implantation site.

The strategic importance of the encapsulated sand system is related to:

1) the increasing trend of coastal use since 20th century;

2) the fact that much of the coastal around the world is suffering from ongoing erosion;

3) the impact that coastal defense works had on coastal processes.

The present invention may present a circular fabric, thus allowing the possibility of making a single tube (a single seamless circular element) either with seams in the tube tops or without any top seams (seamless).

It can also be based on alveolar fabric, thus allowing the creation of tubes with a honeycomb structure. This allows creating separate compartments in the tube which allow a phased filling of the tube, as well as maintaining the structure integrity in case of failure of the compartment.

The tubes may have rigid blocks inside, made of concrete (or other material) with determined porosity, hollow or not, thus allowing to reduce the volume of filling sediments in zones where the sediments are not available, or the dynamic conditions of the sea only allow for reduced working time periods.

The construction of this type of fabric, circular and alveolar, can also be achieved by loom (circular, Jacquard, etc.), or through the construction of the tubes using fabrics sewn in a certain way inside the tube.

INDUSTRIAL APPLICATION

The main applications of the present invention are in the protection of the coastal and lacustrine border, and in the prevention of erosion namely in the consolidation of dunes. Such as a breakwater, the present invention may be placed underwater (creating artificial reefs, surfing sites, reducing tidal energy, sediment retention, etc.). It has a potential use in rocky terrain due to the yarns used and the type of fabric manufacture, and without risk of tearing thanks to the yarns used and the type of construction of the fabric.

One of the frequent purposes may be the rapid protection of buildings and infrastructures (diversion dams) when flooded rivers surpass their banks or in case of floods following the sudden accumulation of rainwater, protecting the highlands by building dykes, aligning and stacking small to medium size prefilled geo-tubes/geo-recipients. The product can also be used for drainage applications.

Another potential applications are flood control (of rivers and in the cities), drainage applications, dock port protection (concrete beds to stabilize dock wall foundations of piers), barriers for pollution prevention and floating barriers (when filled with floating materials), submarine structure protection (such as oil/gas pipelines), containment structures for rocks and soils in roads and other sites, tetrapod structure matrices that make possible alternative and more effective tetrapod designs, water dams, island construction, motorway separators and shock absorbers, creation of farming sites by containing soils in areas where such soils do not exist or where special soil characteristics should be preserved, construction of marinas, lakes and water parks.

The invention claimed is:

1. An anti-erosion system made of geo-synthetic material comprising:

a) yarn weft manufactured of a polypropylene and polyethylene mixture in a fraction of 50% to 90% of polypropylene and in a fraction of 10% to 50% of polyethylene, said yarn weft being a braiding of filaments, individually placed in braids around a core of filaments manufactured from a mixture of polypropylene and polyethylene in a fraction of 50% to 90% of polypropylene and in a fraction of 10% to 50% of polyethylene; and b) top and edge sewn with a polyethylene braided thread of ultrahigh molecular weight.

2. The system according to claim 1, wherein the yarn is an interleaving of 1680 Denier filaments individually placed in sixteen braids around a core of 5 filaments of 1680 Denier, and in a construction of 3.01 points per centimeter.

3. The system according to claim 1, wherein said system is cylindrical, or tubular, or alveolar.

4. The system according to claim 3, wherein said system is partially filled with sand.

5. The system according to claim 1, wherein the weft forms a single circular element without seams.

6. The system according to claim 1, wherein said system has rigid blocks inside, said blocks being hollow or not.

* * * * *